US006103013A

United States Patent [19]

Stevens, III et al.

[11] Patent Number: 6,103,013

[45] Date of Patent: Aug. 15, 2000

[54] MARKER INSERTING DEVICE FOR WEB CONVERTING APPARATUS

[75] Inventors: William H. Stevens, III, Deltaville, Va.; Kenneth E. Rudolph, Jr., Louisville, Ky.

[73] Assignee: Philip Morris Incorporated, New York, N.Y.

[21] Appl. No.: 09/057,768

[22] Filed: Apr. 9, 1998

[51] Int. Cl.[7] ..... B05C 1/14

[52] U.S. Cl. ..... 118/708; 118/249; 118/256; 118/257; 118/261; 131/284; 131/35; 131/37

[58] Field of Search ..... 118/257, 708, 118/249, 256, 261; 156/578; 131/284, 35, 37

[56] References Cited

U.S. PATENT DOCUMENTS 3,625,226 12/1971 Flesselles .
4,715,390 12/1987 Nichols et al. .
4,846,454 7/1989 Parkander .
5,249,416 10/1993 Adams et al. .

*Primary Examiner*—Laura Edwards
*Attorney, Agent, or Firm*—Clinton H. Hallman, Jr.; Kevin B. Osborne; Charles E. B. Glenn

[57] ABSTRACT

This disclosure relates to a method and apparatus for reliably inserting a tab or other marker into a bobbin of material which is undergoing a converting or other processing step. A spindle having a retention device such as a vacuum or magnetic zone which holds the tab or marker with an adhesive side facing outwardly is described. In operation, the spindle is moved into engagement with the surface of the web and the tab or marker is applied precisely and with considerable force. Reduction in unplaced tabs, paper jams, and tearing may be accomplished by the reduction of user error.

23 Claims, 6 Drawing Sheets

MARKER INSERTING DEVICE FOR WEB CONVERTING APPARATUS

I. BACKGROUND OF THE INVENTION

A. Field of the Invention

This invention relates to the field of flexible web handling and processing; especially the handling of webs supplied on long rolls known as bobbins. More specifically, this invention relates to a method and apparatus for inserting a tab into a web of paper in high-speed manufacturing procedures which involve a converting step, e.g. laser perforation, menthol application, or the like.

B. Description of the Related Art

It is customary in the art, e.g. of cigarette manufacturing, to perform converting functions on lengthy rolls of paper or the like provided in bobbins. Bobbins are long lengths of the flexible material wound up upon a core. Cigarettes use substantial amounts of paper in their production—as a packaging material, a cigarette wrapper, to enclose filter tow material as filters, and to tip filters onto columns of wrapped tobacco, to name a few exemplary uses. As used herein, "web" refers to not only paper, but also includes foils, fabrics, polymer tapes, etc., which are supplied in a lengthy form suitable for storage in bobbins.

Conversion as used herein refers to a function such as application of a substance (e.g. menthol, adhesive, odorants); perforation, either mechanically or by thermal energy transfer (e.g. focused laser energy or the like), printing, embossing, slitting, or other comparable functions on paper, films, or other flexible webs.

For ease of illustration; however, a single embodiment will generally be referred to in the specification (application of menthol to a metal foil), but one of skill in the art may easily see where this disclosure may have a wide range of applications. The protection afforded by this application should therefore be measured with reference to the appended claims and not the examples herein.

During converting, some amounts of paper, foil, or the like (usually at the beginning of the web) are lost as waste because of insufficient, incomplete, or no processing. The processing starts at a certain point along the web to be of acceptable quality.

It would be desirable to provide a device which could identify and help segregate the waste material such as this.

Presently operational machines address this segregation requirement in a rather primitive fashion. An operator manually places an adhesive tab on a swinging arm having a flat surface adapted to receive the adhesive. The arm is arcuately movably positioned between the web path and a roller downstream from the converting apparatus. Upon extension of the arm, the tab is inserted into the space between the web and the roller, where it is "pinched" sufficiently to adhere to the paper and be pulled off the arm. The tab is then wound up into the spool of converted web material and signifies the end of the good material.

Placement of the adhesive tab is critical, as the swinging arm is brought into a very close contact with the paper. If too much of the tab adheres to the arm it will not be inserted, or will tear, or become misaligned and cause a web jam in the machine, or a break in the web.

It would be useful to have a more reliable method of inserting a tab into the wound up web on a spool which would be less dependent on operator skills and provide a precise placement on the web, thereby further reducing waste.

Other art known to the applicants is as follows. Each of the following cited patents are hereby incorporated in their entireties by reference.

U.S. Pat. No. 4,715,390 discloses the coating of plug wrap with a menthol by way of example, and U.S. Pat. No. 5,249,416 describes the use of a packaging stock with a pre-applied adhesive. U.S. Pat. No. 4,846,454 describes an apparatus for manufacturing forms from a continuous web of paper by cutting the web on electronic command from a sensor which detects a preprinted separation mark. Finally, U.S. Pat. No. 3,625,226 describes a marking device for marking a wrapper containing cigarettes. Once a preselected number has been counted, an electromagnet is energized to mark the wrapper tape in the machine.

In conventional operation, rolls of material are generally unwound, the conversion function is performed upon the paper, and the new bobbin wound up on a new bobbin core.

However, it is inevitable that losses are incurred during the conversion at conversion startup. For example, the web speed is constantly changing as it ramps up to operating speed and it has been heretofore virtually impossible to control the amount of ink, pressure, adhesive, embossing, etc. being applied. Conventional rewinders in the laser perforating area can cause the loss of about 25 meters of paper at startup.

As noted above, this wasted paper is generally wound about the core of the rewinder, and an adhesive tab inserted into the bobbin at the point where the menthol application, perforation or other conversion is within acceptable limits or of sufficient quality to be inserted into consumer or other goods, usually at a thickness of about 8 mm around the core; often as much as 12–14 mm. Segregation of this waste is thus important to prevent further downstream manufacture of finished products and additional wastage.

The only known equipment is discussed above, and its reliability is subject to improvement, given the waste which can occur if a tab is incorrectly inserted, not inserted at all, or causes a paper jam. A solution to this problem is needed.

II. OBJECTS OF THE INVENTION

It is therefore an object of the present invention to reduce waste by providing a method of reliably inserting a tab or other identifying marker into a bobbin of material during processing or converting.

It is a further object of the present invention to provide an apparatus which inserts the tab with great precision at a location where the web quality is acceptable, also reducing the amount of wasted paper or other web.

It is a further object of the present invention to provide a more automated means for introducing a tab into a bobbin of material to reduce user error.

III. SUMMARY OF THE INVENTION

Applicants have devised a novel apparatus and method for inserting a tab into converted bobbins. The present invention provides a novel spindle for the insertion of a tab into the bobbin in a precisely selected location along the way with positive engagement. Vacuum action or magnetic action holds the tab onto the spindle.

IV. BRIEF DESCRIPTION OF THE DRAWINGS

V. DETAILED DESCRIPTION OF THE PREFERRED EMBODIMENTS

Figure 1:
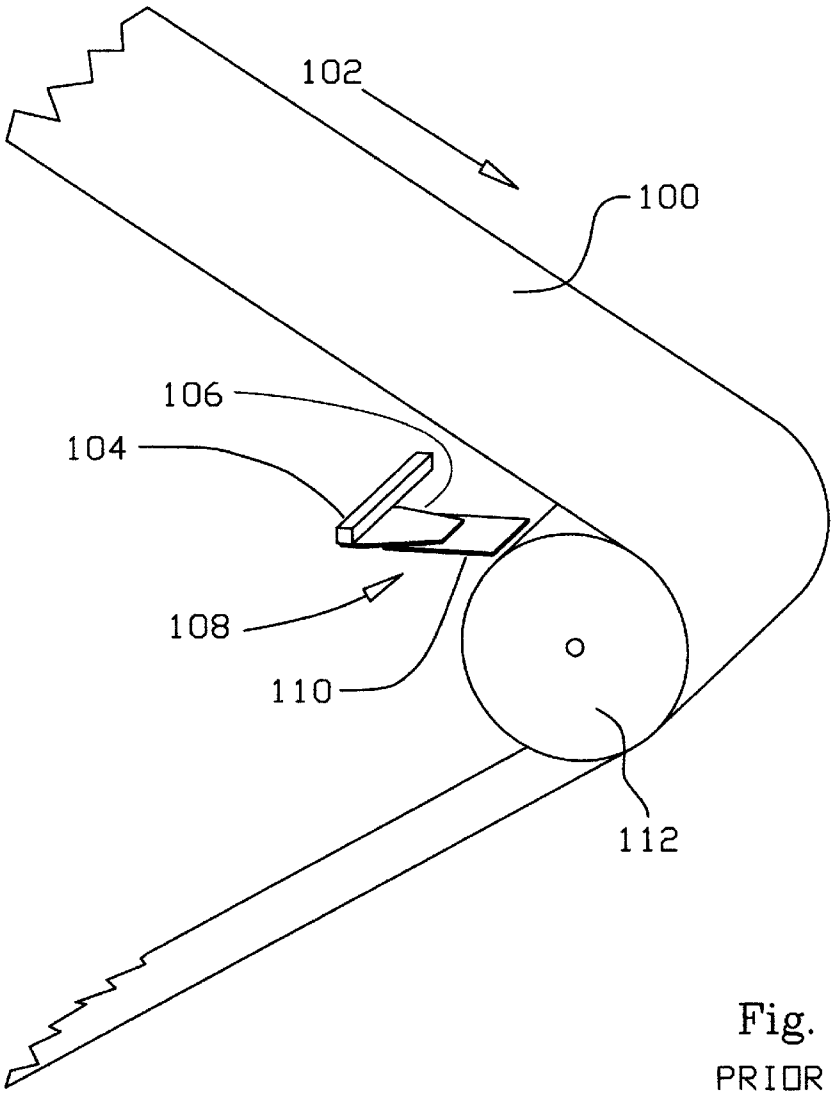
Fig. 1 PRIOR ART
FIG. 1 is a partial perspective view of a prior art tab inserting apparatus.

A prior art tab insertion system is seen in FIG. 1. Web of material 100 travels in the direction of arrow 102. Upon actuation, arm 104 having flat surface 106 swings in the direction of arrow 108. This arcuate motion places single sided adhesive tab 110, which in this configuration has the adhesive on the upper surface, in intimate pinched contact with the paper 100 and the roller 112. The tab is then drawn off the flat surface 106 and carried off by the paper. It is compressed between roller 112 and paper 100 to seat the tab.

It is clear from this figure that the tab must manually be placed in a physically awkward location. The precision of the placement is critical for successful draw off and placement within the bobbin. Additionally, the swinging motion of the prior art is nonlinear, leading to imperfect alignment. The present invention allows for consistent, secure, and aligned placement of the tabs in precisely selected locations, and reduces operator effort.

Figure 2:
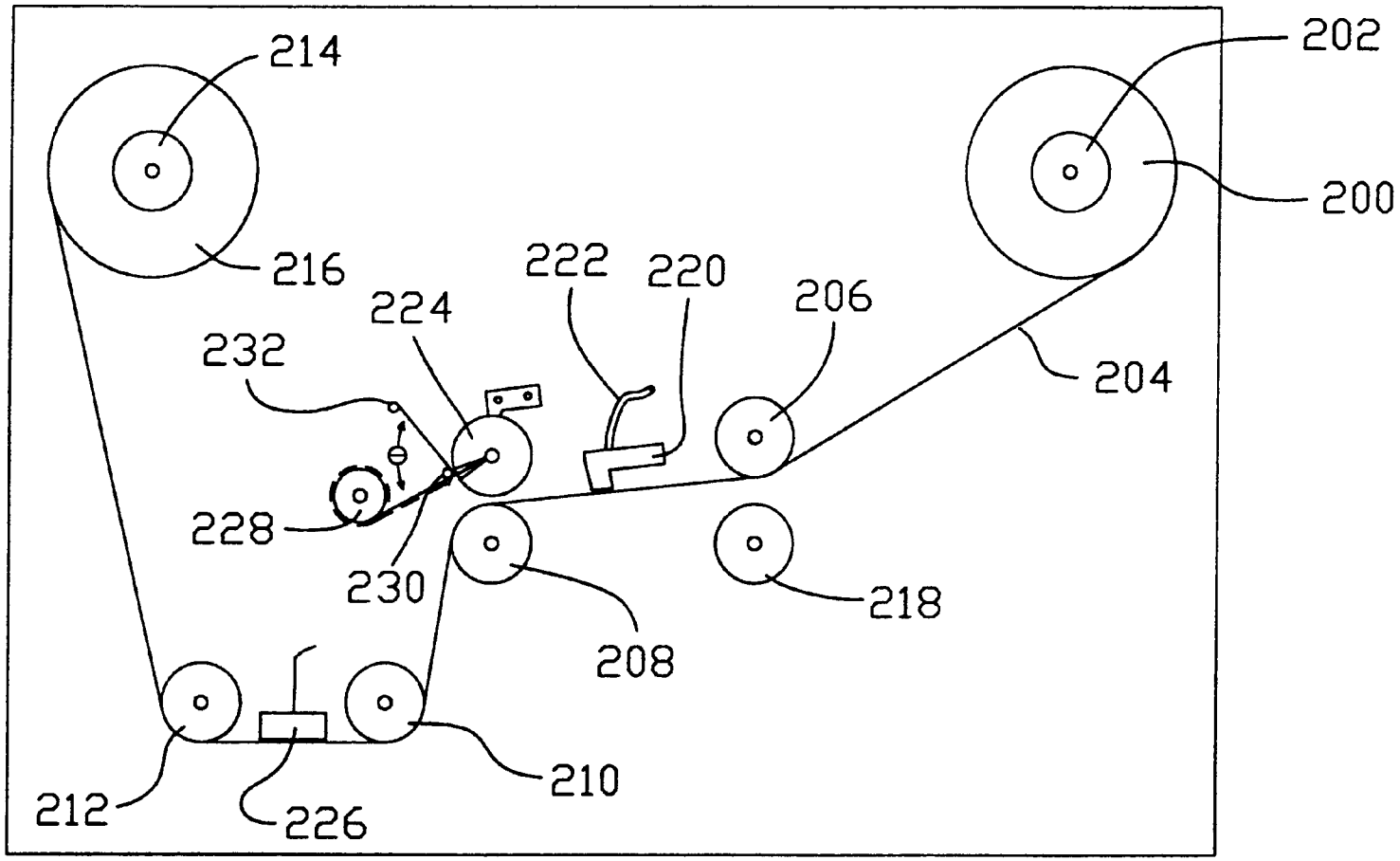
FIG. 2 is a side view of a converter having a paper path consistent with the present invention.

FIG. 2 illustrates a preferred paper path for the apparatus according to the present invention. Feed bobbin 200 is mounted on spindle 202. The web 204 feeds past first positioning roller 206, past second positioning roller 208, past third positioning roller 210, past fourth positioning roller 212, to be wound up upon receiving spindle 214 as converted or processed bobbin 216.

A variety of converting functions can be performed on a platform such as this. For example displaceable roller 218, which may travel in an up-down direction to engage first positioning roller 206, may be an embossing roller, or contain perforating pins, or apply glue, or simply index the web as it travels by. Other uses may be recognized by one of skill in the art having regard for this disclosure.

Applicator 220 may be a spray nozzle or a contact spreader for adhesives and the like, or menthol or other flavorants. Feed line 222 feeds the applicator from a reservoir (not shown). Tab applicator roller 224 is vertically displaceable to engage second positioning roller 208. Inspection device 226 is provided to assure web quality and to check for placement of a tab. Automatic tab feed roller 228 optionally can continuously provide tabs to the tab applicator roller 224.

Figure 3:
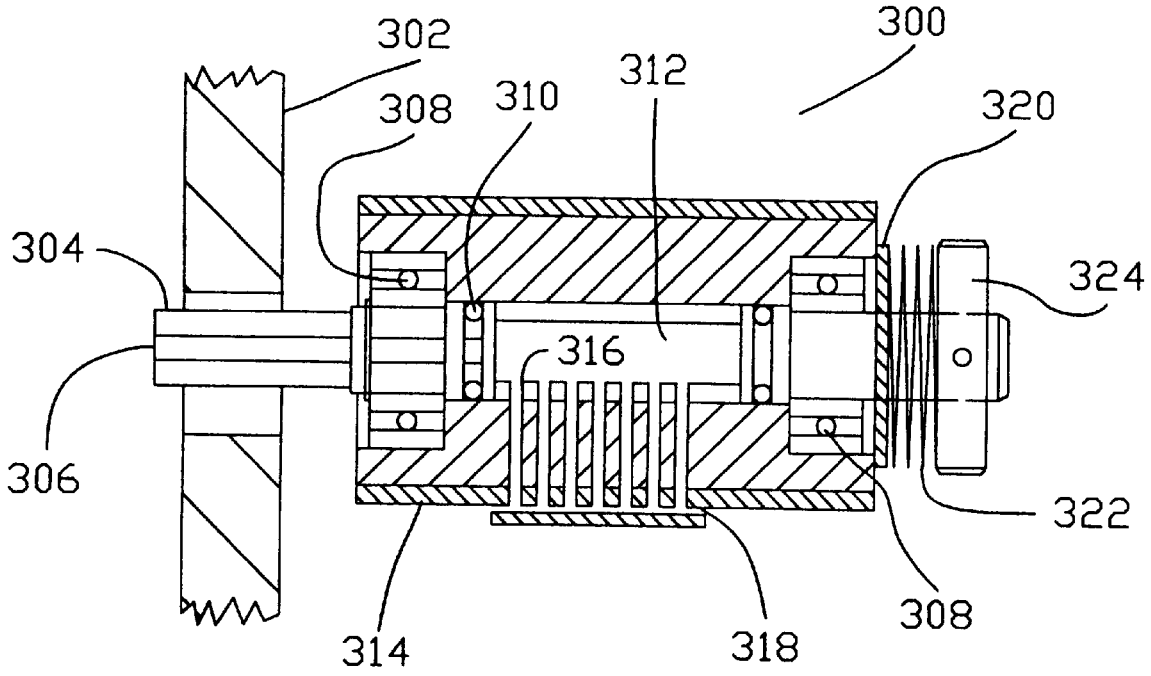
FIG. 3 is a cross sectional view of a spindle according to the present invention.

Turning to FIG. 3, an exemplary novel spindle according to the present invention is seen. The spindle 300 is mounted to machine 302 via hollow axle 304. Axle 304 is formed with conducting passage 306 running longitudinally therethrough. A vacuum may be applied by vacuum means (not shown).

The spindle rotates on axle 304 by virtue of bearings 308. O-rings 310 keep chamber 312 under the influence of vacuum applied through conducting passage 306. Spindle housing 314 presents a uniform surface to the web as it travels along the spindle.

Multiple perforations 316 are formed in the spindle and housing, and the multiple perforations are in fluid connection with the vacuum chamber and conducting passage, such that when vacuum means is applied to the conducting passage, a vacuum is felt at the external openings 318 of the multiple perforations.

Optionally, the spindle may be biased towards the machine by plate 320, pressed inwardly by biasing spring 322, held in placeby collar 324.

Figure 4:
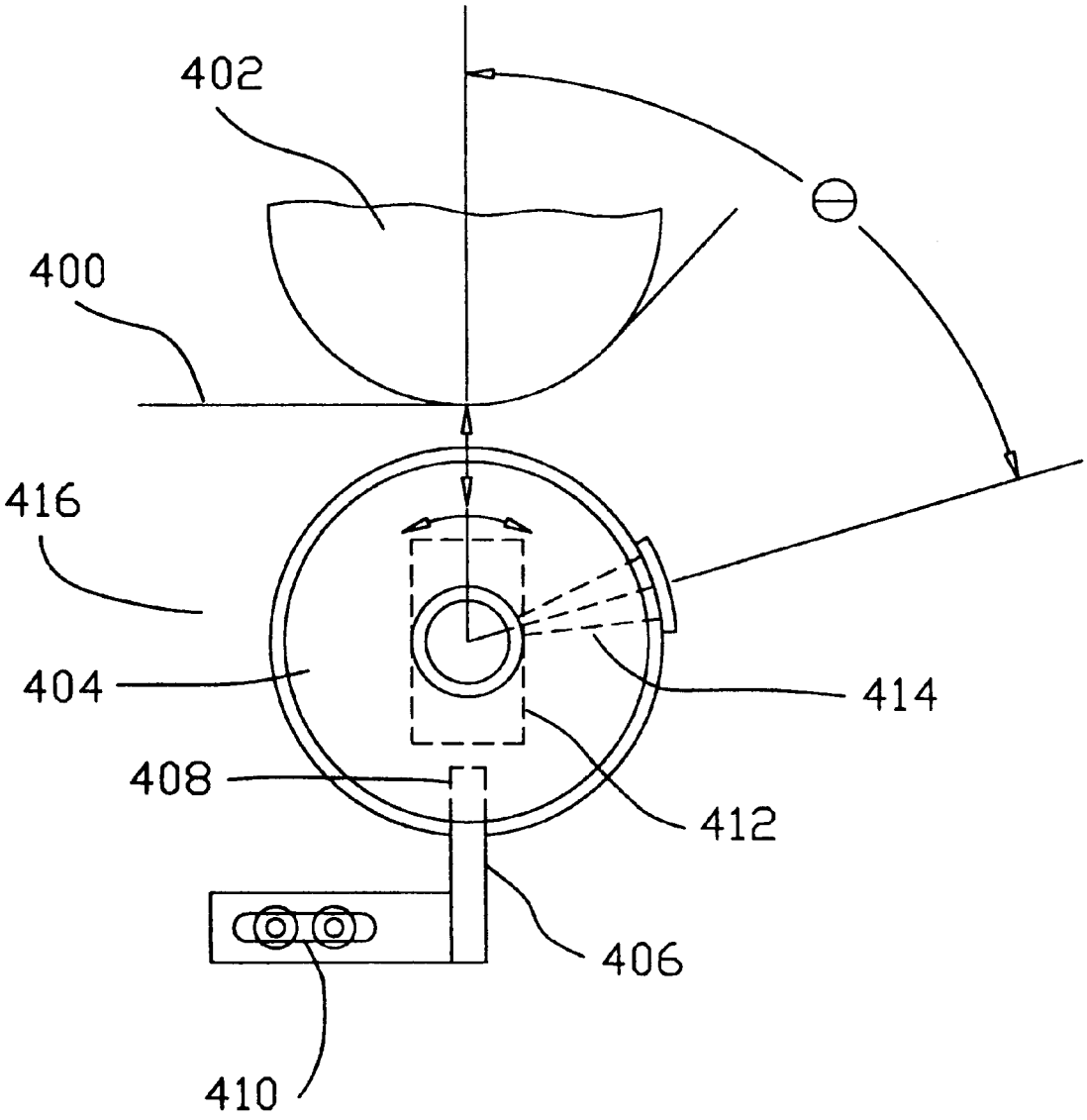
FIG. 4 is a side view of a spindle according to the present invention in conjunction with a pinch roller.

Turning now to FIG. 4, the operation of the spindle with the tabs is more clearly seen. Paper web 400 travels past positioning roller 402. When the machine control (not shown) determines that the web quality is acceptable, a piston drives the piston upwardly.

Prior to the upward motion, the spindle 404 is not in contact with the traveling web. It optionally may be in contact with a detent stop 406, which has a corresponding slot 408 in the spindle. This detent stop locks the spindle in place, guaranteeing a particular spacing of the tab once the signal is given to drive the spindle upward. This may be easily adjusted by adjustable mounting device 410.

The spindle axle travels in slot 412 allowing engagement with the positioning roller. In this view, it is apparent that the perforations 414 in the spindle extend not only longitudinally but also radially. This, a preferably rectangular or square arrangement of perforations appears on the surface of the roller and is most preferably in exactly the shape of the tab to be inserted into the roll of flexible material being processed or converted.

It will be noted by one of skill in the art having regard for this disclosure that by appropriate selection of the angle theta the placement of the tab may be adjusted on the web. If the adjustable mounting device is moved in a direction, the angle theta will increase or decrease, and correspondingly move the tab forwards or backwards on the web from the moment the spindle 416 is actuated upwards.

Figure 5:
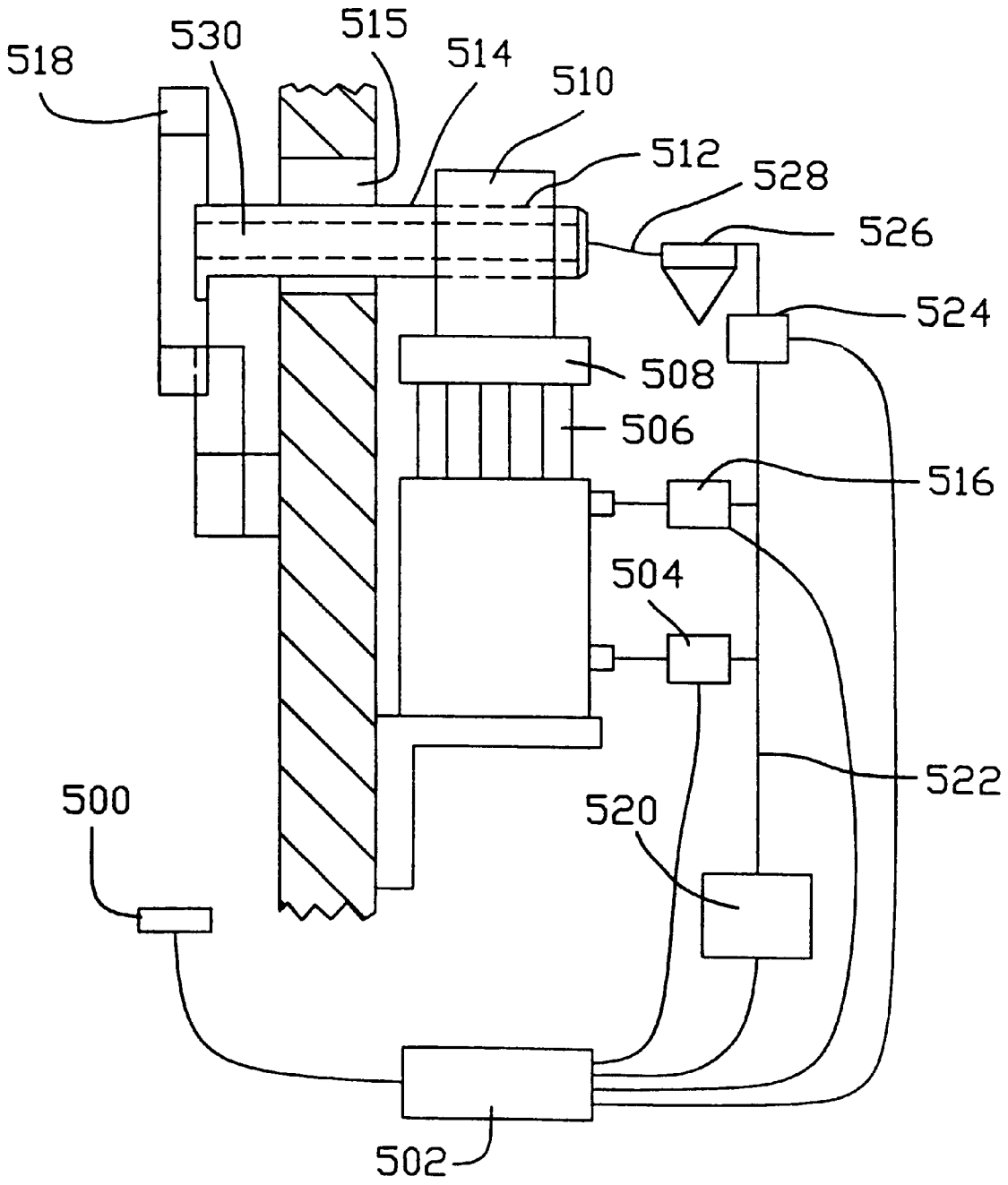
FIG. 5 is a side view of the actuation system of the present invention.

Turning now to FIG. 5, the actuation system is illustrated in side view. Sensor 500 optionally senses web quality and sends a signal to central controller 502. Central controller 502 then actuates solenoid valve 504 to activate pistons 506 driving them upwardly. The pistons carry transverse bar 508 which is integral with horizontal stabilizer 510. Horizontal stabilizer 510 is formed with aperture 512 therethrough, into which axle 514 is inserted. It is apparent that this arrangement enables the axle to be maintained in a horizontal alignment yet travel vertically in slot 515.

In reverse, solenoid 516 is actuated which reverses pistons 506 to draw the transverse bar 508 and horizontal stabilizer 510 downwardly, carrying axle 514 and spindle 518 (shown partially) therewith. Motive force is provided by high pressure air source 520 supplied by conduit 522 to the solenoid valves which act as on/off switches. The vacuum source is also supplied by high pressure air, which is controlled through solenoid valve 524. This valve supplies high pressure air to venturi 526, which acts to generate a vacuum which is then supplied through tube 528 to the longitudinal conducting passage 530, thence to the spindle 518 as previously described.

Figure 6:
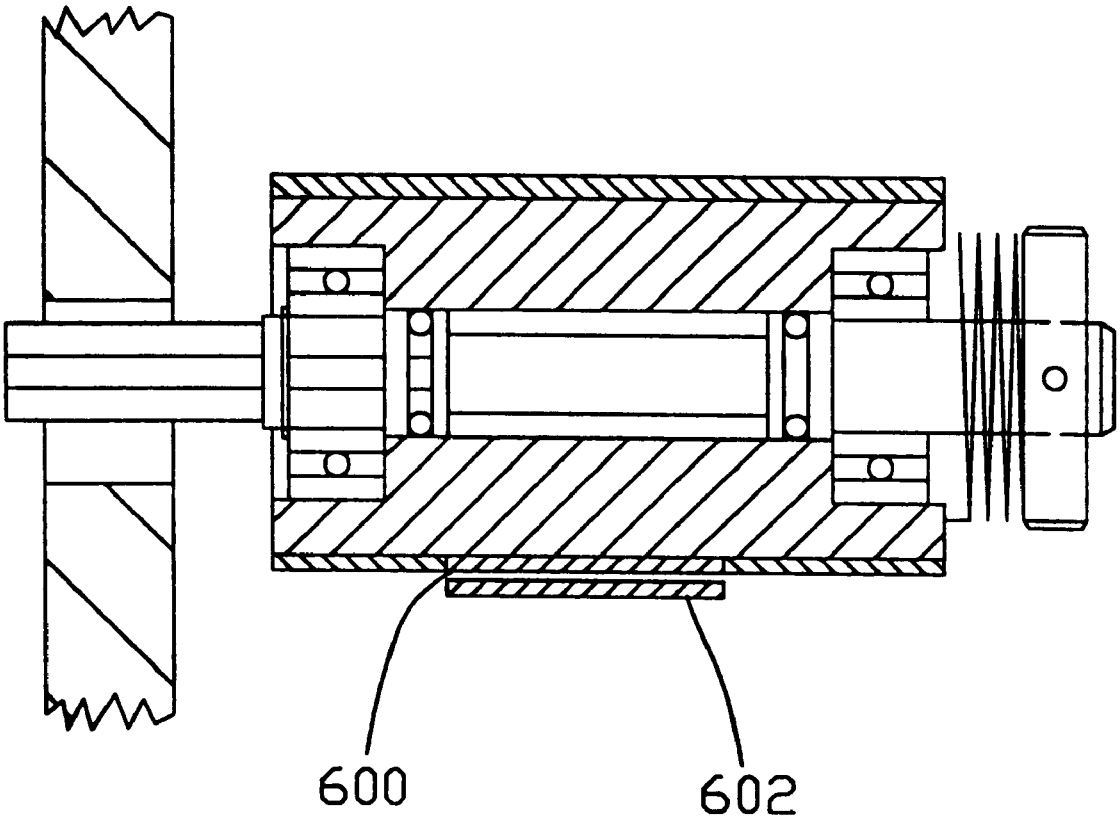
FIG. 6 is a cross sectional view of an alternative embodiment of a spindle according to the present invention.

FIG. 6 illustrates another example of the present invention, wherein the vacuum is replaced by a magnetic retention device 600. The adhesive tabs are supplied with a corresponding ferrous or opposite pole magnetic strip which provides for positive engagement of the adhesive tab 602. The magnetic or ferrous containing tab then can be sensed during later manufacturing processes to indicate when the web is feeding unacceptable material into the manufacturing process.

It should be noted that in all embodiments of the present invention, the adhesive is facing away from the spindle, which is in sharp contrast to the known prior art. This enables the web to enter into uninhibited contact with the tab and seat solidly.

Returning to FIG. 2, the automatic tab feeder will now be described. A roll of adhesive tabs is supplied on roll 228, and are fed to first roller 230 thence to receiving roller 232. The adhesive tab tape is thus given a bending angle theta which is sufficient to cause the tab to begin to detach from the tape. At that point it is contiguous with the vacuum portion of the spindle, which removes the tab from the supply tape. Roller 230 may be an indexing roller to effectuate precise delivery of the tab to the vacuum (or magnetic) spindle. Rollers 228 and 232 are therefore controlled by the machine control to ensure the tape is properly positioned for tab delivery. It should be noted that this automated delivery system may be completely dispensed with, and an operator may position the tab upon the tab receiving zone manually.

It should also be noted in FIG. 2 that the spindle is located above the web, Thus, actuation will occur in the downward direction.

Other modifications and improvements and equivalent structures for accomplishing the objects of the present invention will now be apparent to one of skill in the art having regard for this disclosure.

Having described the invention as above, we claim:

1. An apparatus for inserting an identifying marker in a bobbin of a flexible material, comprising a first spindle configured to receive a bobbin of wound flexible material mounted on a core and unwind the material, a second spindle configured to receive a core and wind material thereupon, a flexible material pathway between the first and second spindles, at least one positioning roller contiguous to the flexible material pathway, and a third spindle having a peripheral surface for applying the identifying marker, said third spindle being spaced apart from the flexible material, mounted upon a displaceable axle which permits the spindle to be displaced such that it abuts the positioning roller with the flexible paper pathway therebetween, said third spindle comprising a marker receiving zone which holds the marker upon the peripheral surface of the spindle.

2. An apparatus as claimed in claim 1, wherein the marker receiving zone is provided with at least one surface aperture which applies vacuum force to hold the marker thereupon.

3. An apparatus as claimed in claim 1, wherein there are a plurality of surface apertures spaced across the marker receiving zone.

4. An apparatus as claimed in claim 3, wherein the surface apertures are spaced both radially and across the length of the spindle.

5. An apparatus as claimed in claim 4, wherein there are three rows of apertures across the length of the spindle.

6. An apparatus as claimed in claim 1, wherein the marker receiving zone is magnetic.

7. An apparatus as claimed in claim 2, wherein the spindle is formed with a hollow chamber in fluid connection to the at least one surface aperture, said hollow chamber being connected to a vacuum source.

8. An apparatus as claimed in claim 7, wherein the hollow chamber is connected to the vacuum source by an axle having a communicating passageway therethrough.

9. An apparatus as claimed in claim 1, wherein the displaceable axle is mounted upon an actuating device which translates the axle into contact with the flexible material pathway.

10. An apparatus as claimed in claim 9, wherein the actuating device is a pneumatic cylinder.

11. An apparatus as claimed in claim 1, further comprising a process controller which senses when the flexible material should be provided with a marker, then actuates the actuating device.

12. An apparatus as claimed in claim 1, further comprising a marker feed section for serially providing markers automatically to the third spindle.

13. An apparatus as claimed in claim 12, wherein the marker feed section comprises at least one roller configured to present a marker in close proximity to the marker receiving zone.

14. An apparatus for inserting an identifying marker in a bobbin of a flexible material, comprising a first spindle configured to receive a bobbin of wound flexible material mounted on a core and unwind the material, a second spindle configured to receive a core and wind material thereupon, a flexible material pathway between the first and second spindles, at least one positioning roller contiguous to the flexible material pathway, and a third spindle having a peripheral surface for applying the identifying marker, said third spindle being spaced apart from the flexible material, mounted upon a displaceable axle which permits the spindle to be displaced such that it abuts the positioning roller with the flexible paper pathway therebetween, said third spindle comprising a marker receiving zone provided with a source of vacuum, said source of vacuum being in fluid communication with a plurality of spaced-apart apertures which hold the marker upon the peripheral surface of the spindle.

15. An apparatus as claimed in claim 14, wherein the spindle is formed with a hollow chamber in fluid connection to the at least one surface aperture, said hollow chamber being connected to a vacuum source.

16. An apparatus as claimed in claim 14, wherein the displaceable axle is mounted upon pneumatic cylinder which translates the axle into contact with the flexible material pathway.

17. An apparatus as claimed in claim 14, further comprising a process controller which senses when the flexible material should be provided with a marker, then actuates the actuating device.

18. An apparatus as claimed in claim 14, wherein the vacuum source is a venturi.

19. An apparatus for inserting an identifying marker in a bobbin of a converted flexible material, comprising a first spindle configured to receive a bobbin of wound unconverted flexible material mounted on a core and unwind the material, a second spindle configured to receive a core and wind converted flexible material thereupon, a flexible material pathway between the first and second spindles, a converting device located along the flexible material pathway for performing a processing step upon the flexible web, at least one positioning roller contiguous to the flexible material pathway and downstream from the converting device, a third spindle having a peripheral surface for applying the identifying marker, said third spindle being spaced apart from the flexible material and mounted upon a displaceable axle which permits the spindle to be displaced such that it abuts the positioning roller with the flexible paper pathway therebetween, said third spindle comprising a marker receiving zone provided with a source of vacuum, said source of vacuum being in fluid communication with a plurality of spaced-apart apertures which hold the marker upon the peripheral surface of the spindle, and a process controller for receiving a signal from a sensor, said signal indicative of flexible material quality, determining an appropriate location for a marker to be placed, generating a signal to actuate the displaceable axle to bring the third spindle into contact with the positioning roller and deliver the marker onto the flexible web.

20. An apparatus as claimed in claim 19, wherein the converting device comprises a device for the application of a liquid material.

21. An apparatus as claimed in claim 20, wherein the liquid material comprises menthol or adhesive.

22. An apparatus as claimed in claim 20, further comprising a sensor device downstream from the converting device, said sensor being in communication with the process controller.

23. An apparatus as claimed in claim 22, wherein the sensor device sends a signal to the process controller corresponding to a measured physical parameter.

* * * * *